US007001539B2

(12) United States Patent
Oda et al.

(10) Patent No.: US 7,001,539 B2
(45) Date of Patent: Feb. 21, 2006

(54) COMPOSITE SUBSTANCE CONTAINING METAL PARTICLES, CONDUCTIVE PASTE AND MANUFACTURING METHOD THEREOF

(75) Inventors: Kazuhiko Oda, Chuo-ku (JP); Tetuji Maruno, Chuo-ku (JP); Kouji Tanaka, Chuo-ku (JP); Akira Sasaki, Chuo-ku (JP)

(73) Assignee: TDK Corporation, Tokyo (JP)

( * ) Notice: Subject to any disclaimer, the term of this patent is extended or adjusted under 35 U.S.C. 154(b) by 0 days.

(21) Appl. No.: 09/879,043

(22) Filed: Jun. 13, 2001

(65) Prior Publication Data

US 2002/0015832 A1 Feb. 7, 2002

(30) Foreign Application Priority Data

Jun. 15, 2000 (JP) ..... 2000-180342

(51) Int. Cl.
*H01B 1/22* (2006.01)

(52) U.S. Cl. ..... 252/512; 252/514; 252/351; 428/210

(58) Field of Classification Search ..... 252/514, 252/512, 351; 428/210
See application file for complete search history.

(56) References Cited

U.S. PATENT DOCUMENTS 4,552,691 A * 11/1985 Shoji et al. ..... 252/514
4,766,027 A * 8/1988 Burn ..... 428/210
5,062,891 A * 11/1991 Gruber et al. ..... 106/20
5,198,154 A * 3/1993 Yokoyama et al. ..... 252/514
5,468,695 A * 11/1995 Carroll et al. ..... 501/79
5,612,121 A * 3/1997 Tani et al. ..... 428/210
5,653,918 A * 8/1997 Towlson ..... 252/514
6,086,793 A * 7/2000 Tani et al. ..... 252/512
6,153,078 A * 11/2000 Fleming et al. ..... 205/119
6,320,738 B1 * 11/2001 Yamana et al. ..... 361/321.2
6,349,026 B1 * 2/2002 Nakamura ..... 361/303
6,551,527 B1 * 4/2003 Yoshida et al. ..... 252/512
6,746,628 B1 * 6/2004 Kamikoriyama et al. ... 252/513

FOREIGN PATENT DOCUMENTS

| | | |
|---|---|---|
| JP | 4-365806 | 12/1992 |
| JP | 5-101708 | 4/1993 |
| JP | 8-246001 | 9/1996 |
| JP | 2000-45001 | 2/2000 |
| JP | 2000-48644 | 2/2000 |
| JP | 2000-68106 | 3/2000 |
| WO | WO 01/57885 | 8/2001 |

* cited by examiner

*Primary Examiner*—Cathy F. Lam
(74) *Attorney, Agent, or Firm*—Oblon, Spivak, McClelland, Maier & Neustadt, P.C.

(57) ABSTRACT

A composite substance for forming a conductive paste, comprises a solvent being compatible with an organic component included in the conductive paste, and metal particles wetted by the solvent. The conductive paste comprises an organic binder, the composite substance and an organic solvent mixed with the organic binder and the composite substance. The method for manufacturing the composite substance comprises the step of adding the solvent to undried metal particles having been washed with water, the solvent being compatible with the organic binder included in the conductive paste and incompatible with water so that the water is replaced by the solvent. The method for manufacturing the conductive paste comprises the step of mixing an organic binder and an organic solvent with the composite substance.

12 Claims, 2 Drawing Sheets

PRIOR ART

COMPOSITE SUBSTANCE CONTAINING METAL PARTICLES, CONDUCTIVE PASTE AND MANUFACTURING METHOD THEREOF

BACKGROUND OF THE INVENTION

1. Field of the Invention

The present invention relates to a composite substance containing metal particles used to constitute a conductive paste, a conductive paste and a manufacturing method thereof.

2. Discussion of Background

As the miniaturization of electronic devices has been pursued with more vigor in recent years, it has become crucial to provide more compact electronic components for use in such electronic devices. In particular, a great deal of effort has been made to achieve further miniaturization as well as an improvement in the characteristics, for electronic components such as inductors, capacitors and filters constituted of ceramic, by adopting a multilayer lamination structure.

These laminated components are manufactured by mixing ceramic powder with an organic vehicle, printing a conductive paste to constitute electrode on a green sheet prepared through a means such as sheeting or printing, baking the green sheet assembly having undergone steps such as lamination, crimping and cutting and then forming external electrodes. The conductive paste is prepared by dispersing a specific type of metal powder into an organic vehicle (organic binder) and an organic solvent.

The various methods through which the metal powder used in the conductive paste is manufactured in the prior art include the gas-phase chemical reaction method, the precipitation reduction method, the reduction deposition method and the thermal reduction method. In any of these manufacturing methods, the metal powder is first washed with water and is then dried. The conductive paste is prepared by dispersing the dried metal powder into the organic vehicle and the organic solvent.

However, dried metal powder tends to aggregate easily, resulting in formation of aggregated metal particles having a particle size larger than the natural particle size of the metal powder. In particular, since increasingly fine metal powder is used nowadays to support the reduction in the film thickness of electrode films, such aggregations in the metal powder tend to occur more frequently.

A conductive paste prepared by dispersing aggregated metal powder into an organic vehicle and an organic solvent, contains large aggregated metal particles. If electrodes of electronic components are formed by using a conductive paste containing aggregated metal particles, the reliability and yield of the electronic components will be greatly compromised. For instance, as shown in FIG. 4, aggregated metal particles 11 may manifest at internal electrodes 1 formed at a ceramic laminated component. If the particle size of the aggregated metal particles 11 becomes larger than the film thickness of the internal electrodes 1, the ceramic 2 is greatly stressed in the area between the internal electrodes 1, resulting in a marked reduction in the reliability and a lower yield of the ceramic laminated component.

Since the aggregated metal particles can only be separated into metal particles having the original particle size through a longer mixing/dispersion step implemented in the conductive paste manufacturing process, poor process efficiency and increased production costs are bound to result.

In addition, while the metal powder is first mixed with the organic vehicle and the organic solvent and then is mixed and dispersed in the conductive paste by utilizing a triple roller in the prior art, the dispersion process implemented by using the triple roller involves various types of potential problems due to the mechanical structure of the triple roller and the process itself requires the worker to be highly experienced and skilled. Thus, it is a very complicated process that requires strict production management. Furthermore, since the dispersion step is a lengthy process, the production costs are bound to rise.

SUMMARY OF THE INVENTION

It is an object of the present invention to provide a composite substance and a conductive paste, in which metal particles do not become aggregated.

It is a further object of the present invention to provide a composite substance and a conductive paste that greatly improve the reliability and the yield of electronic components.

It is a still further object of the present invention to provide a method for manufacturing the composite substance and the conductive paste described above at low cost.

In order to achieve the objects described above, the composite substance for forming a conductive paste comprises a solvent which is compatible with an organic component included in the conductive paste, and metal particles or metal-compound particles wetted by the solvent.

Because the composite substance comprises a solvent which is compatible with an organic component included in the conductive paste, and metal particles or metal-compound particles wetted by the solvent as described above, the metal particles or metal-compound particles (hereinafter simply called "metal particles"), having a particle size smaller than 1 $\mu$m, e.g., a particle size as small as 0.2 $\mu$m or smaller, do not become aggregated, unlike the dried metal particles disclosed in the prior art. Thus, the various problems attributable to aggregation of metal particles are eliminated, and the reliability and the yield of electronic components such as inductors, capacitors and filters constituted of ceramic can be greatly improved.

In addition to disallowing aggregation of metal particles, the composite substance can be disbursed into an organic vehicle and an organic solvent to achieve a conductive paste, in an extremely smooth, consistent and speedy manner since the solvent of the composite substance is compatible with the organic binder used to make the conductive paste.

As a result, a great reduction can be achieved in the length of time required to mix and disperse the composite substance, thereby achieving an improvement in the process efficiency and a reduction in the production costs.

The content of the solvent used to wet the metal particles should be 2 to 100 weight units relative to 100 weight units of the metal particles. This solvent may contain an organic vehicle.

The method of manufacturing the composite substance according to the present invention used to form the conductive paste according to the present invention, comprises the step of adding a solvent to undried metal particles having been washed with water, the solvent being compatible with an organic component included in the conductive paste and incompatible with water so that the water is replaced by the solvent.

The method of manufacturing the composite substance as described above does not include a step of drying the metal particles. Thus, aggregation of the metal particles does not occur.

Since the solvent which is added to undried metal particles having been washed with water is incompatible with water, the solvent becomes deposited on the metal particles while remaining separated from the water. In FIG. 1, which schematically illustrates this state, a solvent 13 adheres around a metal particle 12. In the state shown in FIG. 1, the metal particle 12 on which the solvent 13 adheres precipitates and becomes separated from the water.

Any solvent known to be incompatible with water may be used as the solvent in the process of manufacturing the composite substance according to the present invention. Terpineol is an example of a solvent that may be used in this application. The solvent is added at a rate of 3 to 30 weight units relative to 100 weight units representing the total quantity of the metal particles.

Furthermore, the metal particles may be manufactured through any of the manufacturing methods adopted in the prior art such as a gas-phase chemical reaction method, a precipitation reduction method, a reduction deposition method and a thermal reduction method.

It is desirable to add a surface active agent together with the solvent to enhance the wetting effect of the solvent on the metal particles. Any of surface active agents in the known art including cation surface active agents, non-ionic surface active agents and anionic surface active agents may be used for this purpose. The surface active agent should be added to at a rate of 0.05 to 10.0 weight units relative to 100 weight units representing the total quantity of the metal particles. In FIG. 2, which schematically illustrates the state of a metal particle achieved by adding a surface active agent, a surface active agent 14 adheres around the metal particle 12 with the solvent 13 adhering around the surface active agent 14.

It is even more desirable to add a second solvent achieving compatibility with water, in addition to the solvent described above. FIG. 3 schematically illustrates the state of the metal particle achieved by adding a second solvent. As shown in FIG. 3, by adding a second solvent 16, water 15, which remains on the metal particle 12 in a very small quantity can be completely and quickly removed from the metal particle with the second solvent 16.

The second solvent should be added at a rate of 0.3 to 30 weight units relative to 100 weight units representing the total quantity of the metal particles. Acetone is a specific example of a solvent that may be utilized as the second solvent. Acetone, which is highly volatile, reacts with water and causes the water to become volatile.

The metal particles may be manufactured through any of the manufacturing methods adopted in the prior art such as a gas-phase chemical reaction method, a precipitation reduction method, a reduction deposition method and a thermal reduction method. However, regardless of which of these manufacturing methods is adopted, the drying step, which normally must be implemented, is not performed. Namely, the solvent is added to wet the metal particles, which have been washed with water but have not been dried. There are hardly any restrictions imposed upon the material to constitute the metal particles adopting the present invention. The present invention may be widely adopted in conjunction with metal particles constituted of Ni, Cu, Ag and Fe or alloys of these metals.

The conductive paste comprises an organic binder, the composite substance heretofore explained, and an organic solvent which is mixed with the organic binder and the composite substance.

The method of manufacturing the conductive paste according to the present invention, comprises the step of mixing the organic binder and the organic solvent with the composite substance heretofore explained, namely the composite substance comprising a solvent being compatible with the organic binder, and metal particles wetted by the solvent.

BRIEF DESCRIPTION OF THE PREFERRED EMBODIMENTS

Figure 1:
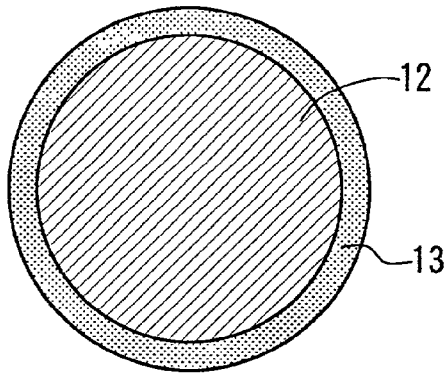
FIG. 1 schematically illustrates a state with a solvent adhering to an undried metal particle having been washed with water in the manufacturing method according to the present invention.
Figure 2:
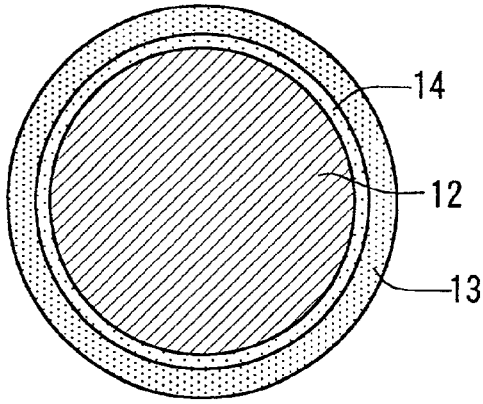
FIG. 2 schematically illustrates a state of the metal particle after a surface active agent is added in the manufacturing method according to the present invention.
Figure 3:
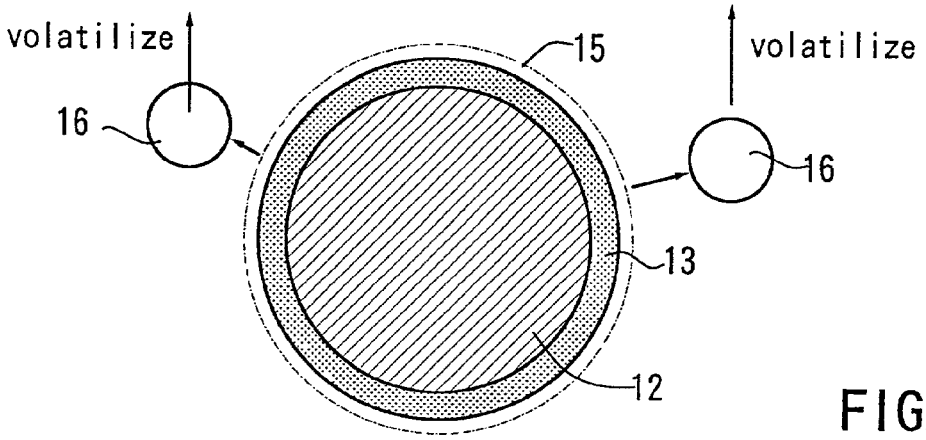
FIG. 3 schematically illustrates a state of the metal particle after a second solvent is added in the manufacturing method according to the present invention.
Figure 4:
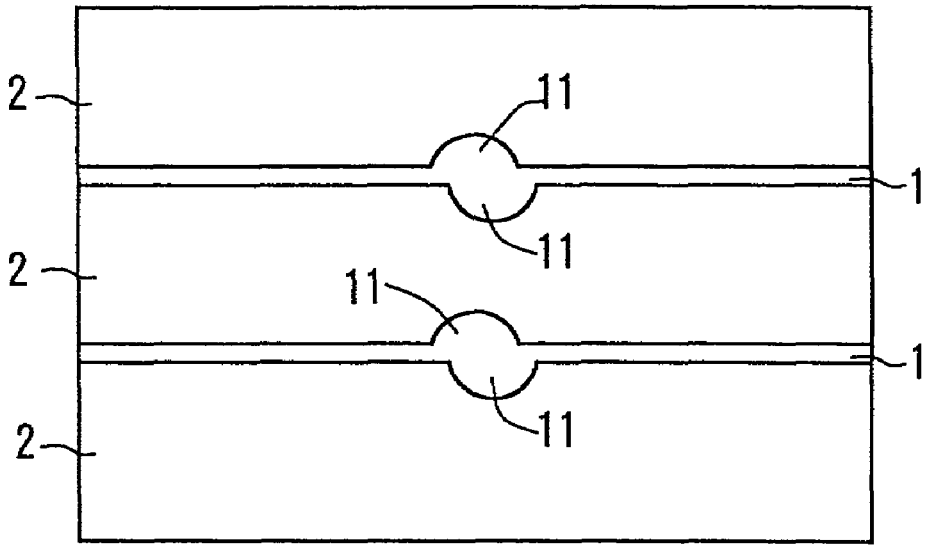
FIG. 4 illustrates the problem of the prior art.

The following is a detailed explanation of the present invention, given in reference to embodiments. It is to be noted that the present invention is not limited by these examples.

Embodiment 1

Method of Manufacturing the Composite Substance

Ni metal particles obtained through the gas-phase chemical reaction method were washed with water and a slurry containing Ni metal particles having an average particle size of 0.35 $\mu$m and water was obtained. In this slurry, water was contained at a rate of 80 weight units relative to 100 weight units of the Ni metal particles.

Terpineol to function as a solvent and a cation surface active agent were mixed into the slurry at rates of 3 to 30 weight units and 0.05 to 10.0 weight units respectively, and then the mixture was agitated to cause the Ni metal particles to aggregate and precipitate, separating from the water. By adding acetone at a rate of 0.3 to 30 weight units at this point, the speed at which the Ni metal particles aggregate and precipitate was increased, thereby effectively eliminating the water in the slurry, to be replaced with terpineol.

The resulting composite substance containing metal particles contains 43 weight units of organic components relative to 100 weight units of Ni metal particles with an average particle size of 0.35 $\mu$m.

Embodiment 1

Method of Manufacturing the Conductive Paste

A conductive paste was manufactured by using the composite substance containing metal particles obtained through the process described above and by adding and mixing in an organic binder and an organic solvent so as to achieve a Ni metal particle content of 50 wt. % and a specific degree of viscosity. This conductive paste was formed into sheets through the doctor-blade method and the conductive paste sheeting was then dried. This conductive paste sheeting is referred to as test piece No. 1.

COMPARATIVE EXAMPLE 1

Method of Manufacturing Metal Powder

Ni metal particles obtained through the gas-phase chemical reaction method were washed with water and then dried, thereby obtaining Ni metal particles (dried Ni metal powder) with an average particle size of 0.35 μm.

COMPARATIVE EXAMPLE 1

Method of Manufacturing Conductive Paste

A conductive paste was manufactured by using the Ni metal powder obtained through the process described above and by adding and mixing in an organic binder and an organic solvent so as to achieve a Ni metal particle content of 50 wt. % and a specific degree of viscosity. This conductive paste was formed into sheets through the doctor-blade method and the conductive paste sheeting was then dried. This conductive paste sheeting is referred to as test piece No. 2.

Evaluation Method and Evaluation Results

The density and the surface roughness of dry sheets were evaluated for test pieces 1 and 2. The density of a dry sheet was evaluated by using a value obtained by cutting a dried sheet into specific dimensions and calculating the density in conformance to the volume and the weight of the cut piece.

The surface roughness of a dry sheet was measured for evaluation by using a surface roughness gauge (SURF-MU 570 A Ruby Terminal 0.8 mmR, manufactured by Tokyo Seimitsu Co. Ltd.). The results of the evaluation are presented in TABLE I. Each numerical value in TABLE I represents the average among 10 sample pieces.

TABLE I

| Test | Ni metal | dry sheet | dry sheet surface roughness (μm) | |
|---|---|---|---|---|
| Piece No. | material state | density (g/cm$^3$) | Ra | Rmax |
| 1 | wet | 5.8 | 0.03 | 0.28 |
| 2 | dried powder | 5.3 | 0.06 | 0.54 |

As indicated in TABLE I, the dry sheet surface roughness values Ra and Rmax of test piece No. 1 obtained through embodiment 1 of the present invention are approximately half the surface roughness values of test piece No. 2 presented as comparative example 1, and thus, it can be concluded that an electrode film with an extremely smooth surface can be obtained by using test piece No. 1.

Embodiment 2

Method of Manufacturing the Composite Substance

Ag metal particles obtained through the gas-phase chemical reaction method were washed with water and a slurry containing Ag metal particles having an average particle size of 0.15 μm and water was obtained. In this slurry, water was contained at a rate of 80 weight units relative to 100 weight units of the Ag metal particles.

Terpineol to function as a solvent and a cation surface active agent were mixed into the slurry at rates of 3 to 30 weight units and 0.05 to 10.0 weight units respectively, and then the mixture was agitated to cause the Ag metal particles to aggregate and precipitate, separating from the water. By adding acetone at a rate of 0.3 to 30 weight units at this point, the speed at which the Ag metal particles aggregate and precipitate is increased, thereby effectively eliminating the water in the slurry, to be replaced with terpineol.

The resulting composite substance containing metal particles contains 43 weight units of organic components relative to 100 weight units of Ag metal particles with an average particle size of 0.15 μm.

Embodiment 2

Method of Manufacturing the Conductive Paste

A conductive paste was manufactured by using the composite substance containing metal particles obtained through the process described above and by adding and mixing in an organic binder and an organic solvent so as to achieve a Ag metal particle content of 80 wt. % and a specific degree of viscosity. This conductive paste was formed into sheets through the doctor-blade method and the conductive paste sheeting was then dried. This conductive paste sheeting is referred to as test piece No. 3.

COMPARATIVE EXAMPLE 2

Method of Manufacturing Metal Powder

Ag metal particles obtained through the gas-phase chemical reaction method were washed with water and then dried, thereby obtaining Ag metal particles (dried Ag metal powder) with an average particle size of 0.15 μm.

COMPARATIVE EXAMPLE 2

Method of Manufacturing Conductive Paste

A conductive paste was manufactured by using the Ag metal powder obtained through the process described above and by adding and mixing in an organic binder and an organic solvent so as to achieve a Ag metal particle content of 80 wt. % and a specific degree of viscosity. This conductive paste was formed into sheets through the doctor-blade method and the conductive paste sheeting was then dried. This conductive paste sheeting is referred to as test piece No. 4.

Evaluation Method and Evaluation Results

The density and the surface roughness of dry sheets were evaluated for test pieces 3 and 4. The density of a dry sheet was evaluated by using a value obtained by cutting a dried sheet into specific dimensions and calculating the density in conformance to the volume and the weight of the cut piece. The surface roughness of a dry sheet was measured for evaluation by using a surface roughness gauge (SURF-MU 550 A Ruby Terminal 0.8 mmR, manufactured by Tokyo Seimitsu Co. Ltd.). The results of the evaluation are presented in TABLE II. Each numerical value in TABLE II represents the average of 10 sample pieces.

TABLE II

| Test Piece No. | Ag metal material state | dry sheet density (g/cm$^3$) | dry sheet surface roughness ($\mu$m) Ra | Rmax |
|---|---|---|---|---|
| 3 | wet | 6.6 | 0.02 | 0.19 |
| 4 | dried powder | 5.8 | 0.04 | 0.43 |

As indicated in TABLE II, the dry sheet surface roughness values Ra and Rmax of test piece No. 3 obtained through embodiment 2 of the present invention are approximately half the surface roughness values of test piece No. 4 presented as comparative example 2, and thus, it can be concluded that an electrode film with an extremely smooth surface can be obtained by using test piece No. 3.

EFFECTS OF THE INVENTION

As described above, the present invention achieves the following advantages.

(a) A composite substance and a conductive paste in which aggregation of metal particles is not induced are provided.

(b) A composite substance and a conductive paste with which the reliability and the yield of electronic components can be greatly improved are provided.

(c) Methods for manufacturing the composite substance and the conductive paste at low cost are provided.

What is claimed is:

1. Particles for a conductive paste, each of said particles comprising a metal particle and a solvent, wherein said metal particle is wetted by said solvent, and said solvent is compatible with an organic component and insoluble in water, prepared by a process comprising:

adding said solvent to undried metal particles which have been washed with water, thereby replacing said water by said solvent.

2. The particles of claim 1, wherein:

said metal particles have an average particle size of 1 $\mu$m or smaller.

3. The particles of claim 1, wherein: said solvent comprises 2 to 100 parts by weight relative to 100 parts by weight of said metal particles.

4. Particles for a conductive paste, each of said particles comprising a metal-compound particle and a solvent, wherein said metal-compound particle is wetted by said solvent, and said solvent is compatible with an organic component and insoluble in water, prepared by a process comprising:

adding said solvent to undried metal-compound particles which have been washed with water, thereby replacing said water by said solvent.

5. The particles of claim 4, wherein:

said metal-compound particles have an average particle size of 1 $\mu$m or smaller.

6. The particles of claim 4, wherein: said solvent comprises 2 to 100 parts by weight relative to 100 parts by weight of said metal-compound particles.

7. A conductive paste prepared from particles, wherein:

each of said particles comprises a metal particle and a solvent, said metal particle is wetted by said solvent, and said solvent is compatible with an organic component and insoluble in water; and said particles are prepared by a process comprising:

adding said solvent to undried metal particles which have been washed with water, thereby replacing said water by said solvent.

8. The conductive paste of claim 7, wherein:

said metal particles have an average particle size of 1 $\mu$m or smaller.

9. An electronic component comprising:

a ceramic base body; and at least one electrode supported by said ceramic base body, wherein said at least one electrode is formed from the conductive paste of claim 7.

10. A conductive paste prepared from particles, wherein:

each of said particles comprises a metal-compound particle and a solvent, said metal-compound particle is wetted by said solvent, and said solvent is compatible with an organic component and insoluble in water; and said particles are prepared by a process comprising:

adding said solvent to undried metal-compound particles which have been washed with water, thereby replacing said water by said solvent.

11. The conductive paste of claim 10, wherein:

said metal-compound particles have an average particle size of 1 $\mu$m or smaller.

12. An electronic component comprising:

a ceramic base body; and at least one electrode supported by said ceramic base body, wherein said at least one electrode is formed from the conductive paste of claim 10.

* * * * *